US006484339B2

(12) United States Patent
Mossbeck et al.

(10) Patent No.: US 6,484,339 B2
(45) Date of Patent: Nov. 26, 2002

(54) BEDDING OR SEATING PRODUCT WITH NESTABLE STACKABLE MODULES

(75) Inventors: Niels S. Mossbeck, Carthage, MO (US); Jacob J. Neuenswander, Granby, MO (US); Thomas J. Wells, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/773,650

(22) Filed: Jan. 31, 2001

(65) Prior Publication Data

US 2002/0100118 A1 Aug. 1, 2002

(51) Int. Cl.[7] ..... A47C 23/00; A47C 23/053; F16F 3/00

(52) U.S. Cl. ..... 5/716; 5/247; 267/103

(58) Field of Search ..... 5/716, 655.7, 247, 5/263, 255, 267; 267/103, 106

(56) References Cited

U.S. PATENT DOCUMENTS

| | | | | |
|---|---|---|---|---|
| 2,979,739 A | | 4/1961 | Krakauer | 5/719 |
| 5,052,064 A | | 10/1991 | Hagemeister et al. | 5/246 |
| 5,165,125 A | | 11/1992 | Callaway | 5/247 |
| 5,176,367 A | | 1/1993 | Rodgers et al. | 267/103 |
| 5,178,372 A | * | 1/1993 | Rodgers et al. | 267/103 |
| 5,246,210 A | | 9/1993 | Dabney | 267/103 |
| 5,332,202 A | | 7/1994 | Wagner et al. | 267/82 |
| 5,346,188 A | | 9/1994 | Rodgers et al. | 267/106 |
| 5,361,434 A | | 11/1994 | Hagemeister et al. | 5/247 |
| 5,370,374 A | | 12/1994 | Rodgers et al. | 267/103 |
| 5,395,097 A | | 3/1995 | Dabney et al. | 267/103 |
| 5,401,007 A | * | 3/1995 | Dabney et al. | 267/103 |
| 5,414,874 A | | 5/1995 | Wagner et al. | 5/263 |
| 5,426,799 A | | 6/1995 | Ottiger et al. | 5/719 |
| 5,435,023 A | * | 7/1995 | Wagner et al. | 5/270 |
| 5,588,165 A | | 12/1996 | Fromme | 5/247 |
| 5,652,986 A | * | 8/1997 | Wells | 5/716 |
| 5,704,595 A | | 1/1998 | Kitchen et al. | 267/103 |
| 5,720,471 A | | 2/1998 | Constantinescu et al. | 267/81 |
| 5,927,696 A | | 7/1999 | Hagemeister | 267/105 |
| 5,967,499 A | | 10/1999 | McCraw et al. | 267/103 |
| 6,134,729 A | | 10/2000 | Quintile et al. | 5/263 |
| 6,406,009 B1 | * | 6/2002 | Constantinescu et al. | 267/81 |

FOREIGN PATENT DOCUMENTS

| | | | | |
|---|---|---|---|---|
| CA | 2057294 A1 | * | 6/1992 | 5/247 |

* cited by examiner

*Primary Examiner*—Robert G. Santos
(74) *Attorney, Agent, or Firm*—Wood, Herron & Evans, L.L.P.

(57) ABSTRACT

A bedding or seating product comprising a base having a generally rectangular frame and a plurality of internal rails, a wire grid spaced above the base and a plurality of plastic modules connecting the wire frame and the base. Each of the plastic modules has four arms extending upwardly from a bottom portion and terminating in end portions. Each end portion has a pair of perpendicular grooves adapted to receive intersecting wires of the wire grid. The modules are nestably stackable to save space during shipping.

22 Claims, 4 Drawing Sheets

BEDDING OR SEATING PRODUCT WITH NESTABLE STACKABLE MODULES

FIELD OF THE INVENTION

This invention relates generally to bedding or seating products, and more particularly to a box spring bedding product made with plastic spring modules in lieu of coil springs.

BACKGROUND OF THE INVENTION

A conventional box spring comprises a generally rectangular wooden frame, and a generally rectangular wire grid spaced above the wooden frame with a plurality of coil springs. Lower end turns of the coil springs are stapled or otherwise secured to side and end rails of the wooden box spring frame as well as interior rails extending either transversely between the side rails or longitudinally between the end rails (from head to foot). Similarly, the upper end turns of the coil springs are secured to the wire members of the wire grid in any number of ways.

Several patents disclose box springs utilizing springs other than coil springs to space the upper wire grid from the lower wooden frame. For example, U.S. Pat. No. 5,720,471 discloses generally C-shaped spring modules extending between the upper wire grid and a wooden base. This patent also discloses spring modules of differing shapes, such as spring modules having an S-shaped cross-section or a U-shaped cross-section.

However, none of the configurations of spring modules disclosed in U.S. Pat. No. 5,720,471 are configured such that the spring modules may be preassembled to wire grids and shipped to a bedding manufacturer with the spring modules nestably stacked inside one another to conserve space for shipping purposes.

Conventional box spring assemblies occupy a large volume and thus are costly to ship and store in an assembled condition. In order to reduce the space requirements for shipping mattresses, it is customary to compress mattress spring assemblies to reduce their individual thicknesses and to tie them in a compressed state into bales. This compression and shipping process is possible with mattress spring assemblies but is not possible with box spring assemblies because of their lack of compressibility.

Consequently, box spring assemblies which may be preassembled and densely packaged for shipment to a bedding manufacturer are desirable. Such box spring assemblies are known. For example, applicants' own U.S. Pat. No. 5,361,434 discloses a nestably stackable foundation assembly which may be nestably stacked with other similar assemblies for transportation, thereby minimizing shipment costs. As disclosed in this patent, the wooden bases of the box springs, and the nestable, stackable spring foundation assemblies are stacked and shipped separately. At the bedding manufacturers destination, the spring manufacturer assembles the components together into a box spring foundation before upholstering the foundation into a finished bedding product.

Therefore, it has been one objective of the present invention to provide a bedding foundation having molded plastic spring module components which may be attached to a wire grid and nestably stacked for shipping, thereby minimizing shipment costs and maximizing ease of assembly and completion of the upholstered box spring by the bedding manufacturer.

Another object of the present invention has been to provide a bedding foundation which is relatively simple to manufacture and which may substitute for a traditional box spring assembly having coil springs extending between an upper wire grid and a lower wooden-base.

SUMMARY OF THE INVENTION

The invention of this application which accomplishes these objectives comprises a bedding or seating product having a wire grid spaced above a base and a plurality of modules extending between the base and wire grid. Each of the modules comprises a bottom portion adapted to be joined to the base and four arms extending upwardly from the bottom portion. Each of the arms terminates in an end portion having a pair of grooves adapted to receive intersecting wires of the wire grid.

The base is generally wooden but may be made of other materials, such as aluminum struts or foam plastic rails, or combination thereof. The base includes a frame comprising a pair of longitudinally extending side rails, a pair of transversely extending end rails and a plurality of parallel spaced internal rails extending either transversely between the side rails or longitudinally between the end rails.

The wire grid comprises a generally rectangular border wire and a plurality of intersecting transverse and longitudinal wires. The transverse wires extend from side-to-side, and the longitudinal wires extend from end-to-end. The longitudinal and transverse wires are preferably welded or otherwise secured together at their intersections in order to create a unitary wire grid.

The modules of the present invention are preferably made of plastic, but may be made of other materials as well. The modules are nestably stackable inside one another in order to conserve space during shipping. Each of the modules comprises four arms which extend upwardly from a bottom portion of the module, each arm terminating in an end portion. Each end portion has two grooves extending generally perpendicular to one another. One of the grooves is adapted to receive one of the transverse wires of the wire grid, and one of the grooves is adapted to receive one of the longitudinal wires of the grid.

In one of the embodiments of the present invention, each of the modules has a stabilizer bar extending between adjacent arms of the module. The stabilizer bars provide stability and make the module arms less prone to breaking or otherwise being damaged upon excessive overloading of the modules.

These and other objects and advantages of the present invention will be more readily apparent from the following description of the drawings.

DETAILED DESCRIPTION OF THE DRAWINGS

Figure 1:
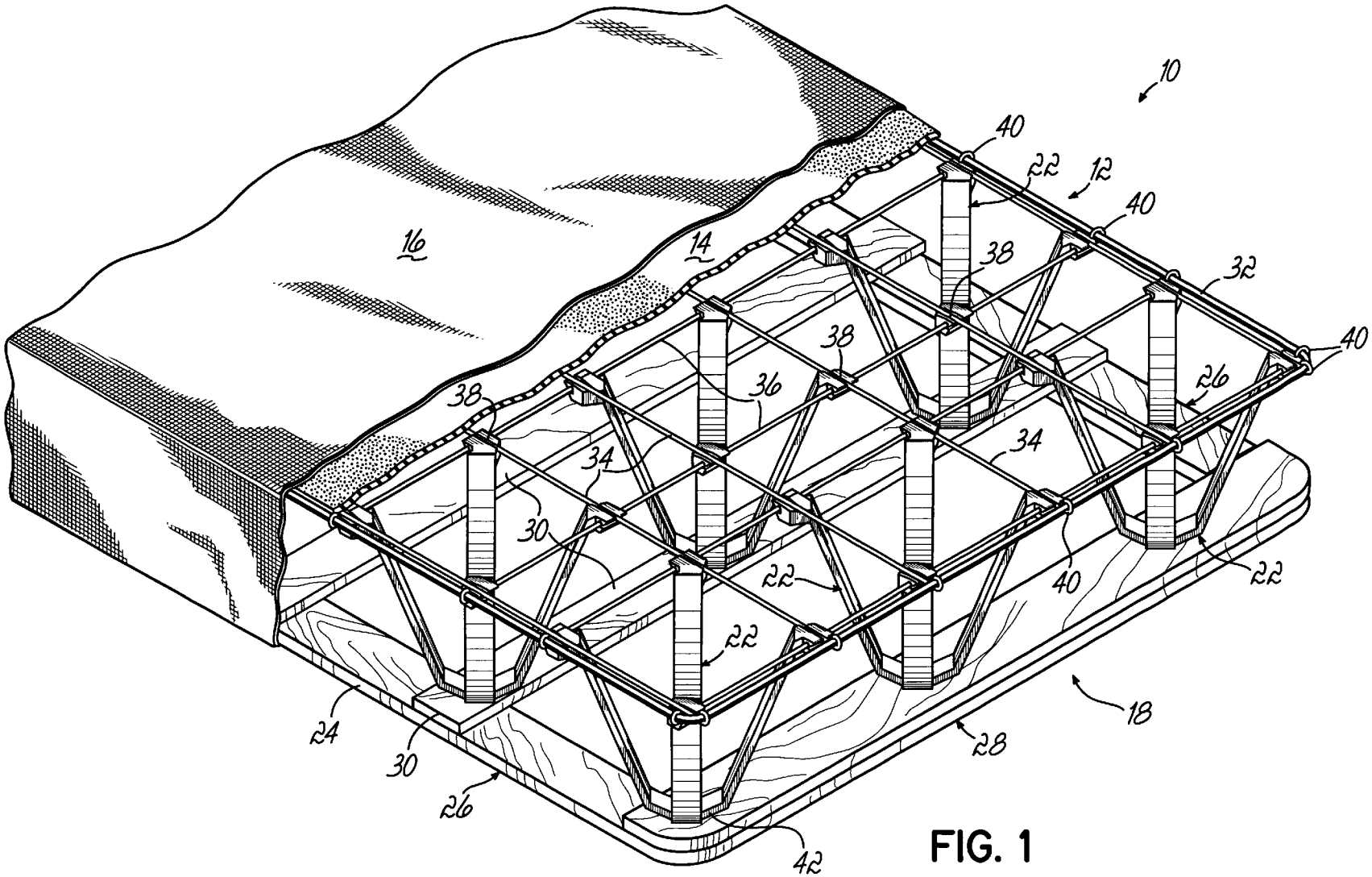
FIG. 1 is a perspective view of a box spring product made in accordance with the present invention.

Referring to the Figures, and particularly to FIG. 1, there is illustrated a bedding or seating product 10 comprising a foundation 12, padding 14 overlying the foundation 12 and an upholstered covering 16 encasing the foundation 12 and the padding 14.

The foundation 12 comprises a base 18, a wire grid 20 spaced above the base 18, and a plurality of modules 22 extending between the base and the wire grid.

The base 18 comprises a generally rectangular frame 24 having a pair of longitudinally extending side rails 26 and a pair of spaced parallel end rails 28. Each of the end rails 28 extends between the ends of the side rails 26. The base 18 further comprises a plurality of spaced internal rails 30, which are illustrated as extending transversely from one side rail to the other side rail. However, the internal rails 30 may extend longitudinally from one end rail to another without departing from the spirit of the invention of this application.

The different rails of the base are preferably wooden but may be made of steel, aluminum struts, foam, plastic or any other material.

The wire grid 20 comprises a generally rectangular perimeter wire 32, a plurality of longitudinal wires 34 and a plurality of transverse wires 36. The longitudinal wires 34 are spaced from one another along the width of the product. Similarly, the transverse wires 36 are spaced from one another along the length of the product. The longitudinal and transverse wires intersect one another at a plurality of intersections 38 at which the wires are preferably welded or otherwise secured to each other in order to form a unitary grid. Similarly, opposite ends 40 of each of the longitudinal wires and each of transverse wires are wrapped around or otherwise secured to the perimeter wire 32 in a manner which is generally known in the art. Other methods of attachment of the longitudinal and transverse wires to the perimeter wire, as for example welding, may be utilized in accordance with the present invention.

Figure 2:
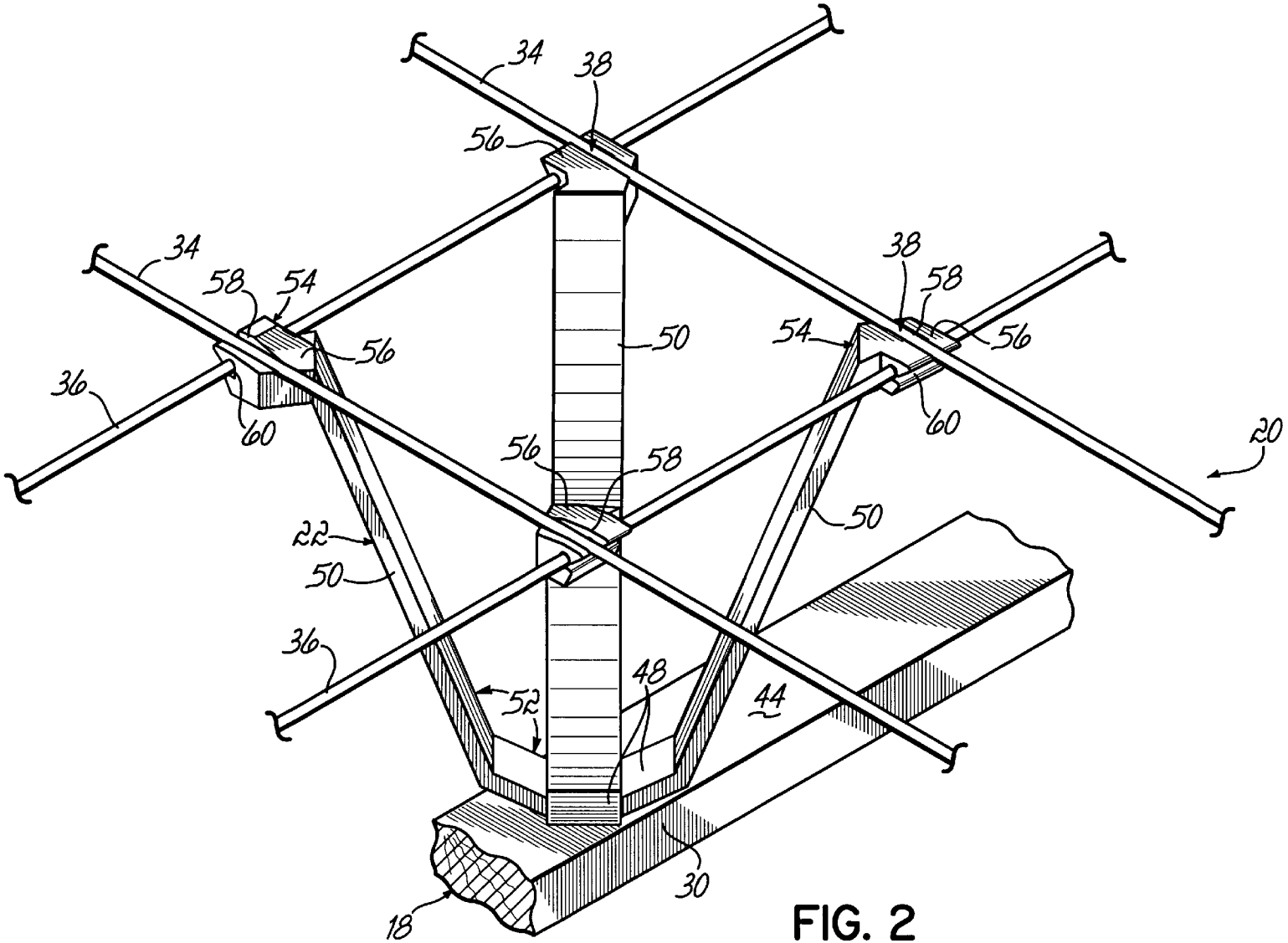
FIG. 2 is a perspective of one of the modules of the box spring bedding product of FIG. 1 extending between a portion of the upper wire grid and a portion of a base.

As best illustrated in FIG. 2, each of the modules 22 extends between the base 18 and the wire grid 20. Each of the modules 22 has a bottom portion 42 which is adapted to be joined to one of the frame rails. The bottom portion 42 of the module 22 may be stapled, glued or otherwise secured to an upper surface 44 of one of the base rails. FIG. 2 illustrates a bottom portion 42 of a module 22 secured to an upper surface 44 of one of the interior rails 30 of the base 18.

Each module 22 further comprises four arms 46 extending generally upwardly from the bottom portion 42 of the module. Each of the arms 46 has a linear lower section 48 and a linear upper section 50 which define an angle 52 therebetween. Each of the arms 46 terminates in an end portion 54 having a generally planar upper surface 56 and a pair of grooves 58,60 formed therein. One of the grooves 58 is adapted to receive a longitudinal wire 34 and extends downwardly from the upper surface 56 of the end portion 54. Similarly, groove 60 is adapted to receive one of the transverse wires 36 of the wire grid. Thus, the grooves 58,60 formed in each end portion 54 of each arm 46 are generally perpendicular or orthogonal to one another. The grooves 58, 60 are configured to allow the wires of the wire grid to be snapped into place and retained.

Each of the modules 22 is preferably made of plastic but may be made of any other material, such as aluminum, for example. This application is not intended to limit the material of the modules in any way.

Although one configuration of end portion 54 is illustrated and described, the end portions may assume other configurations in accordance with the present invention. Additionally, the modules 22 may be oriented such that the groove 58 extending downwardly from the upper surface 56 of the end portion may receive one of the transverse wires 36 of the wire grid.

Figure 3:
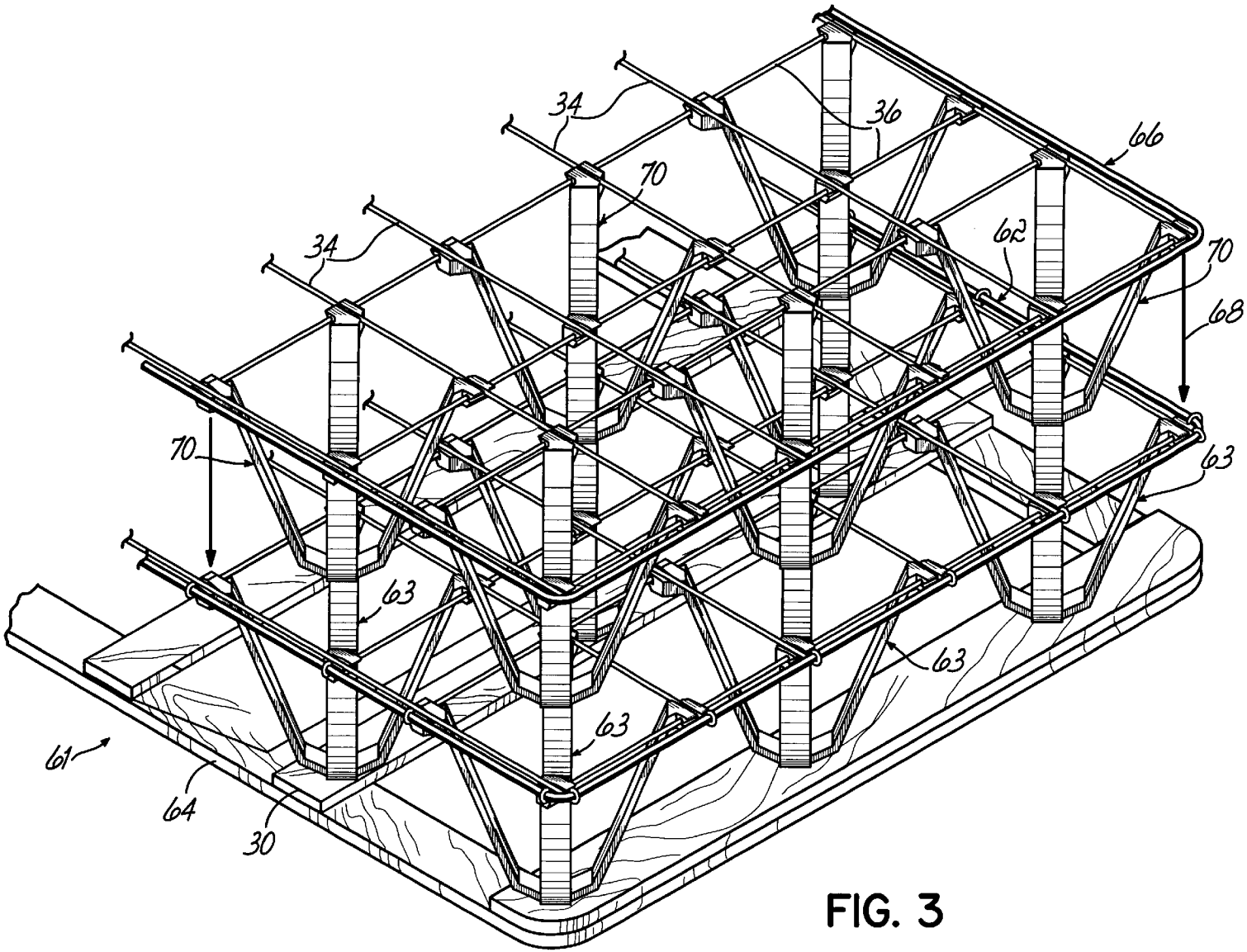
FIG. 3 is a perspective view of a foundation of the present invention and a nestably stackable assembly being lowered in a nestable stacked relation relative to the lower foundation.

Referring to FIG. 3, for purposes of this application the modules and wire grid of a foundation will be considered a nestably stackable assembly. FIG. 3 illustrates a foundation 61 constructed in accordance with the present invention having a first or lower nestably stackable assembly 62 secured to a base 64. In order to save space during shipping a second nestably stackable assembly 66 is illustrated in FIG. 3 as being lowered downwardly in the direction of arrows 68 into a nestably stacked relation relative to the nestably stackable assembly 62 of foundation 61. Thus, the modules 70 of the nestably stackable assembly 66 are nestably stacked inside the modules 63 of the lower foundation 61. In this manner multiple nestably stackable assemblies may be stacked upon one another to save space and expense in shipping.

Once a series of nestably stacked assemblies arrive at a bedding manufacturing facility, they may be unstacked one at a time, the top assembly being removed first. A base may be secured to each of the assemblies in order to form foundations before they are each covered with padding and upholstery as illustrated in FIG. 1. Thus, the nestably stackable foundations are shipped separately from the bases, thereby avoiding the need to ship uncompressed components and have the components assembled by the bedding manufacturer.

Figure 4:
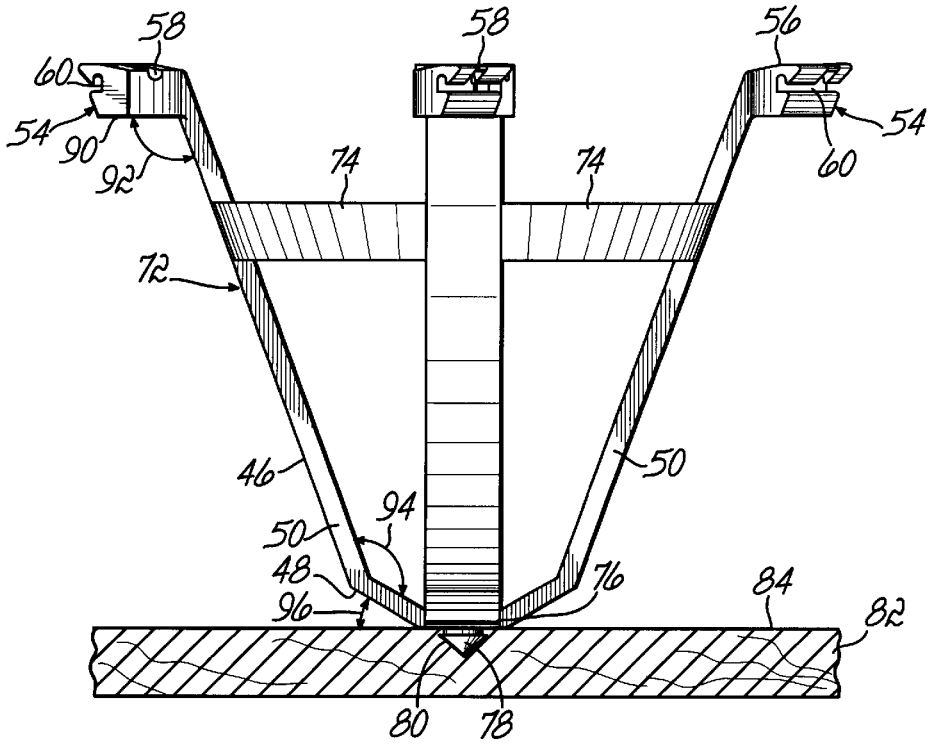
FIG. 4 is a side elevational view of one of the modules of the present invention secured to one of the rails of the base of the present invention.

FIG. 4 illustrates an alternative embodiment of module 72 made in accordance with the present invention. This module 72 is identical to the module 22 illustrated in FIGS. 1 and 2, with two exceptions. First, stabilizer bars 74 extend between adjacent arms, thereby providing stability to the module and reducing the possibility that upon overloading one of the arms may be pulled outwardly, causing the module to break or otherwise be damaged. Secondly, the bottom portion 76 of the module 72 has an anchor 78 extending downwardly therefrom. The anchor is adapted to be pressed or otherwise received in a hole 80 or other receptacle formed in one of the base rails 82. The hole 80 extends downwardly from an upper surface 84 of the rail 82 but does not extend entirely through the rail.

FIG. 4 illustrates an included angle 90 between the lower surface 92 of the end portion 54 of the module 72 and its respective arm 46. Similarly an included angle 94 is formed between the lower section 48 and the upper section 50 of the arm 46. The lower section 48 of the arm 46 forms an included angle 96 with the upper surface 84 of the rail 82. Although these included angles are illustrated to be fixed, they may vary in accordance with the present invention and are not intended to be limited.

Figure 5:
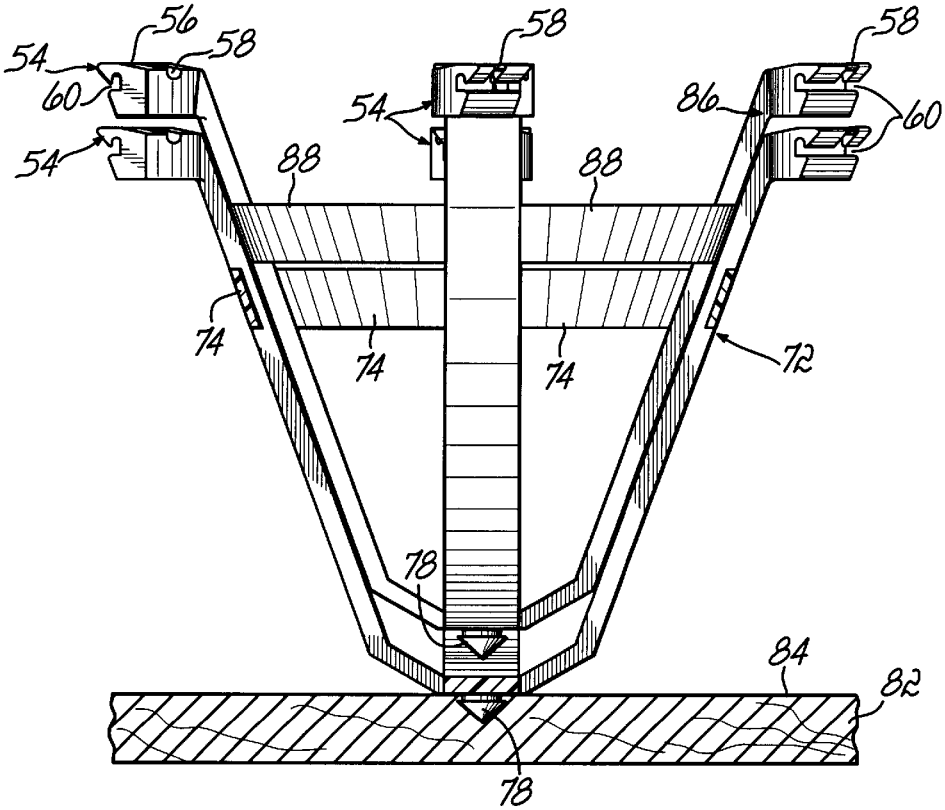
FIG. 5 is a side elevational view partially cut away of two modules like those illustrated in FIG. 4 nestably stacked inside one another.

FIG. 5 illustrates the module 72 of FIG. 4 anchored in a rail 82 having an upper surface 84 in the manner described above but having a second module 86 having stabilizer bars 88 nestably stacked inside the module 72. Although FIG. 5 illustrates one pair of nestably stacked modules, it can be understood by those skilled in the art that all the modules of a nestably stackable assembly may be nestably stacked inside the modules of a lower foundation in the manner illustrated in FIG. 5.

While we have described only two preferred embodiments of our invention, those skilled in the art will readily recognize modifications and changes which may be made without departing from the spirit or scope of the invention. Accordingly, we intend to be limited only by the following claims.

We claim:

1. A bedding or seating product comprising:

a foundation comprising a base and a first nestably stackable assembly secured to said base, said first nestably stack assembly comprising a wire grid spaced above said base and a plurality of nestably, stackable modules extending between said base and said wire grid, said base comprising a frame comprising a pair of longitudinally extending side rails, a pair of transversely extending end rails and a plurality of internal rails, said wire grid comprising a perimeter wire and a plurality of intersecting transverse wires and longitudinal wires, each of said transverse wires and longitudinal wires being joined at opposite ends to said perimeter wire, each of said modules having a bottom portion joined to one of said frame rails, four arms extending generally upwardly from said bottom portion, each of said arms terminating in an end portion having a pair of grooves in which said wires of said wire grid are secured, wherein a second nestably stackable assembly may be nestably stacked inside said first nestably stackable assembly, padding overlying the wire grid of the foundation, an upholstered covering encasing said padding and said foundation.

2. A bedding or seating product comprising:

a foundation comprising a base and a first nestably stackable assembly secured to said base, said first nestably stack assembly comprising a wire grid spaced above said base and a plurality of nestably stackable modules extending between said base and said wire grid, said base comprising a frame comprising a pair of longitudinally extending side rails, a pair of transversely extending end rails and a plurality of internal rails, said wire grid comprising a perimeter wire and a plurality of intersecting transverse wires and longitudinal wires, each of said transverse wires and longitudinal wires being joined at opposite ends to said perimeter wire, each of said modules having a bottom portion joined to one of said frame rails, four arms extending generally upwardly from said bottom portion, each of said arms terminating in an end portion having a pair of grooves in which are received said wires of said wire grid wherein a second nestably stackable assembly may be nestably stacked inside said first nestably stackable assembly.

3. The product of claim 2 wherein said modules are plastic.

4. The product of claim 2 wherein said base is wooden.

5. The product of claim 2 wherein said base is metal.

6. The product of claim 2 wherein said modules are unitary members.

7. The product of claim 2 wherein each of said modules has stabilizer bars extending between said arms of said module.

8. The product of claim 2 wherein said internal rails of said foundation are parallel said side rails of said frame.

9. The product of claim 2 wherein said internal rails of said foundation are parallel said end rails of said frame.

10. A bedding or seating product having a longitudinal dimension and a transverse dimension, said longitudinal dimension being greater than said transverse dimension, said product comprising:

a base including a frame comprising a pair of longitudinally extending side rails, a pair of transversely extending end rails at opposite ends of said side rails and a plurality of parallel internal rails, a first nestably stackable assembly comprising a wire grid and a plurality of nestably stackable modules secured to said wire grid, said wire grid comprising a plurality of intersecting transverse wires and longitudinal wires, each of said modules comprising a bottom portion joined to one of said foundation rails, and four arms extending generally upwardly from said bottom portion, each of said arms terminating in an end portion having a pair of grooves in which are received a pair of intersecting wires of said wire grid, wherein a second nestably stackable assembly may be nestably stacked inside said first nestably stackable assembly.

11. The product of claim 10 wherein said pair of grooves is adapted to receive one of said transverse wires and one of said longitudinal wires.

12. The product of claim 10 wherein each of said end portions of said arms of said module comprises said pair of grooves orthogonal to each other.

13. The product of claim 10 wherein said modules are plastic.

14. The product of claim 10 wherein each of said modules has stabilizer bars extending between said arms of said module.

15. The product of claim 10 wherein said internal rails of said foundation are parallel said side rails of said frame.

16. The product of claim 10 wherein said internal rails of said foundation are parallel said end rails of said frame.

17. A nestably stackable assembly for use in a bedding foundation comprising:

a first nestably stackable assembly comprising a wire grid comprising a generally rectangular border wire, a plurality of spaced, parallel longitudinal wires, a plurality of spaced, parallel transverse wires, said longitudinal and transverse wires being joined at intersections, a plurality of nestably stackable plastic modules secured to said wire grid and extending downwardly therefrom, each of said plastic modules comprising a bottom portion and four arms extending generally upwardly from said bottom portion, each of said arms terminating in an end portion having a pair of grooves, one of said longitudinal wires and one of said transverse wires being located in said grooves, wherein a second nestably stackable assembly may be nestably stacked inside said first nestably stackable assembly.

18. A bedding or seating product comprising:

a base comprising a generally rectangular frame and a plurality of internal rails, said frame comprising a pair of longitudinally extending side rails, a pair of transversely extending end rails secured to opposite ends of said side rails, a first nestably stackable assembly secured to said base and extending upwardly therefrom, said first nestably stackable assembly comprising a wire grid and a plurality of modules secured to said grid, each of said modules comprising a unitary bottom portion adapted to be joined to one of said rails of said base and four arms extending generally upwardly from said bottom portion, each of said arms terminating in an end portion, wherein a second nestably stackable assembly may be nestably stacked on top of said first nestably stackable assembly.

19. The bedding or seating product of claim 18 wherein each of said end portions of said modules has a pair of grooves adapted to receive intersecting wires of said wire grid.

20. A plurality of nestably stacked assemblies comprising:

a base comprising a generally rectangular frame and a plurality of internal rails, said frame comprising a pair of longitudinally extending side rails, a pair of transversely extending end rails secured to opposite ends of said side rails, a first nestably stackable assembly secured to said base and extending upwardly therefrom, said first nestably stackable assembly comprising a wire grid and a plurality of modules secured to said grid, each of said modules comprising a unitary bottom portion joined to one of said rails of said base and four arms extending generally upwardly from said bottom portion, each of said arms terminating in an end portion joined to said wire grid, and a second nestably stackable assembly nestably stacked on top of said first nestably stackable assembly, said second nestably stackable assembly comprising a wire grid and a plurality of modules secured to said grid, each of said modules comprising a bottom portion and four arms extending generally upwardly from said bottom portion, each of said arms terminating in an end portion joined to said wire grid of said second nestably stackable assembly.

21. A foundation for use in a bedding or seating product comprising:

a base comprising a frame comprising a pair of longitudinally extending side rails, a pair of transversely extending end rails and a plurality of internal rails, a wire grid spaced above said base, said wire grid comprising a perimeter wire and a plurality of intersecting transverse wires and longitudinal wires, each of said transverse wires and longitudinal wires being joined at opposite ends to said perimeter wire, and a first set of nestably stackable modules extending between said base and said wire grid, each of said modules having a bottom portion joined to one of said frame rails and four arms extending generally upwardly from said bottom portion, each of said arms terminating in an end portion having a pair of grooves adapted to receive intersecting wires of said wire grid, wherein a second set of nestably stackable modules secured to a second wire grid may be nestably stacked inside the first set of modules.

22. A method of manufacturing a plurality of bedding or seating products, said method comprising:

providing a foundation including a base comprising a generally rectangular frame and a plurality of internal rails, said frame comprising a pair of longitudinally extending side rails and a pair of transversely extending end rails secured to opposite ends of said side rails, securing a first nestably stackable assembly to said base, said first nestably stackable assembly comprising a wire grid and a plurality of modules secured to said grid, each of said modules comprising a unitary bottom portion joined to one of said rails of said base and four arms extending generally upwardly from said bottom portion, each of said arms terminating in an end portion joined to said wire grid, nestably stacking a second nestably stackable assembly on top of said first nestably stackable assembly, said second nestably stackable assembly comprising a wire grid and a plurality of modules secured to said grid, each of said modules comprising a bottom portion and four arms extending generally upwardly from said bottom portion, each of said arms terminating in an end portion joined to said wire grid of said second nestably stackable assembly, unstacking said second nestably stackable assembly from said foundation, and securing said second nestably stackable assembly to a second base to form a second foundation.

* * * * *

UNITED STATES PATENT AND TRADEMARK OFFICE

CERTIFICATE OF CORRECTION

PATENT NO. : 6,484,339 B2 
DATED : November 26, 2002
INVENTOR(S) : Niels S. Mossbeck, Jacob J. Neuenswander and Thomas J. Wells It is certified that error appears in the above-identified patent and that said Letters Patent is hereby corrected as shown below:

Column 1,
Line 55, replace "manufacturers", with -- manufacturer's --.

Column 5,
Line 5, replace "stack" with -- stackable --.
Line 31, replace "stack" with -- stackable --.

Signed and Sealed this

Eighth Day of April, 2003

JAMES E. ROGAN
*Director of the United States Patent and Trademark Office*